US008608596B1

(12) United States Patent
Chang

(10) Patent No.: US 8,608,596 B1
(45) Date of Patent: Dec. 17, 2013

(54) RACKET WITH A MOVABLE THROAT

(71) Applicant: Cheng-Chung Chang, Taichung (TW)

(72) Inventor: Cheng-Chung Chang, Taichung (TW)

( * ) Notice: Subject to any disclaimer, the term of this patent is extended or adjusted under 35 U.S.C. 154(b) by 0 days.

(21) Appl. No.: 13/689,351

(22) Filed: Nov. 29, 2012

(51) Int. Cl.
*A63B 49/02* (2006.01)

(52) U.S. Cl.
USPC ..... 473/546

(58) Field of Classification Search
USPC ..... 473/546, 524, 531, 534, 548
See application file for complete search history.

(56) References Cited

U.S. PATENT DOCUMENTS 1,476,906 A * 12/1923 Santa Maria ..... 473/534
1,790,156 A * 1/1931 Kleinman ..... 473/534
1,912,942 A * 6/1933 Kleinman ..... 473/534
4,094,505 A * 6/1978 Beall, Jr. ..... 473/548
4,976,433 A * 12/1990 Pohlenz et al. ..... 473/534
5,029,857 A * 7/1991 von Hackewitz ..... 473/534
5,133,552 A * 7/1992 Feeney et al. ..... 473/537
5,178,388 A * 1/1993 Schlenker ..... 473/521
5,282,617 A * 2/1994 Hong ..... 473/546
5,560,600 A * 10/1996 FitzSimons et al. ..... 473/463
6,955,618 B1 * 10/2005 Mitchell ..... 473/534

* cited by examiner

*Primary Examiner* — Raleigh W Chiu
(74) *Attorney, Agent, or Firm* — Ming Chow; Sinorica, LLC

(57) ABSTRACT

A racket with a movable throat includes a racket frame having an inner wall disposed with a pivotal groove having a throat member received therein. A racket net is firmly fixed with the inner wall of the racket frame, composed of a plurality of first main strings respectively having one end connected with the throat member. By so designing, when a user employs the racket of this invention to hit balls, the impact force of the ball dashing against the racket net will drive the throat member to sway. Thus, the time that the ball contacts with the racket net can be prolonged to enable a user to control balls more easily and additionally, all the first main strings can be actuated to sway together with the throat member to produce greater resilient force for enhancing power of hitting balls.

5 Claims, 6 Drawing Sheets

RACKET WITH A MOVABLE THROAT

BACKGROUND OF THE INVENTION

1. Field of the Invention

This invention relates to a racket, particularly to one provided with a movable throat.

2. Description of the Prior Art

A conventional racket employed for hitting balls, such as a tennis racket, a squash racket and a racquetball racket, as shown in FIG. 1, includes a grip having one end provided with a racket frame 2 having an inner side adjacent to the grip 1 connected with a throat 3. A racket net 4 made by interlacing plural main strings 5 and cross strings 6 that are arranged in a crisscross pattern is fabricated between the inner wall of the racket frame 2 and the throat 3. Thus, a user can hold the grip 1 to hit balls via the racket net 4.

However, since the racket net 4 of the conventional racket is directly set between the inner wall of the racket frame 2 and the throat 3, and the throat 3 is designed in a stationary condition; therefore, the extent of deformation of the racket net is limited. In this case, when the conventional racket is employed to hit balls, the time that the ball contacts with the racket net 4 will be comparatively short, thus disadvantageous to control of balls and additionally, the ball will contact with only a few of the main strings 5 and the cross strings 6, thus reducing the resilient force that the racket net 4 can produce and hence weakening ball hitting power. Particularly, the impact force that the ball dashes against the racket net 4 will directly be transmitted to both the racket frame 2 and the grip 1, apt to make the conventional racket shock and cause sports injuries to a user.

SUMMARY OF THE INVENTION

The objective of this invention is to offer a racket with a movable throat, able to elevate accuracy of controlling balls, enhancing strength of hitting balls and absorb shock produced during hitting balls.

The racket with a movable throat in the present invention includes a racket body, a throat member and a racket net. The racket body is formed with a grip having one end provided with a racket frame, which has an inner wall disposed with a pivotal groove at a location corresponding with the grip. The throat member has one end formed with a pivotal portion to be pivotally fixed in the pivotal groove and another end extending out of the pivotal groove and provided with a connecting portion. The racket net is fabricated with the inner wall of the racket frame, formed with a plurality of first main strings generally arranged axially along the grip and a plurality of cross strings generally arranged diametrically along the grip. The first main strings respectively have one end connected with the inner wall of the racket frame and another end connected with the connecting portion of the throat member.

Since the first main strings of the racket net are connected with the throat member that is pivotally set in the pivotal groove; therefore, when a user employs the racket of this invention to hit balls, the impact force that the ball dashes against the racket net will be transmitted to the throat member via the first main strings and simultaneously, the throat member will be forced to sway in the direction of the impact force. Thus, not only the time that the ball contacts with racket net can be prolonged to enable a user to control the ball comparatively easily, but also all the first main strings can be actuated to sway together with the throat member, thus able to produce greater resilient strength for hitting a ball with greater power. In addition, swaying of the throat member can produce buffer effect for greatly lowering the impact force that is transmitted to the racket main body and reducing shock produced during hitting of balls, thus avoiding causing sports injuries to a user who has employed the racket body to hit balls for a long period of time.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
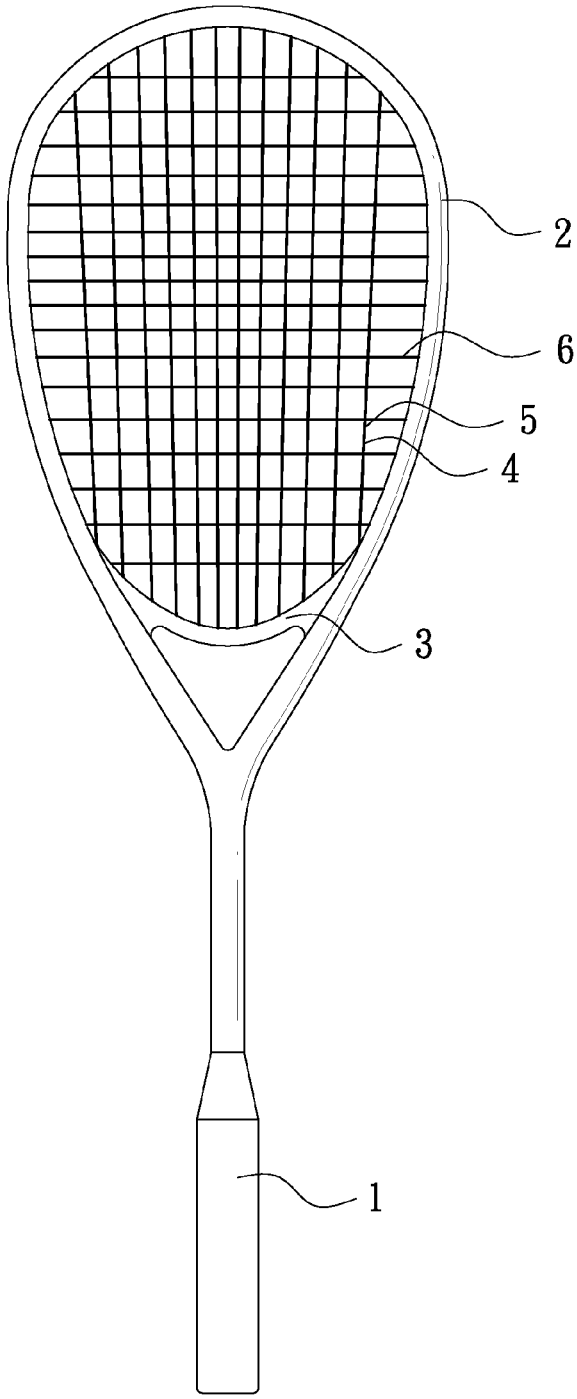
FIG. 1 PRIOR ART
FIG. 1 is a plane view of a conventional racket.
Figure 2:
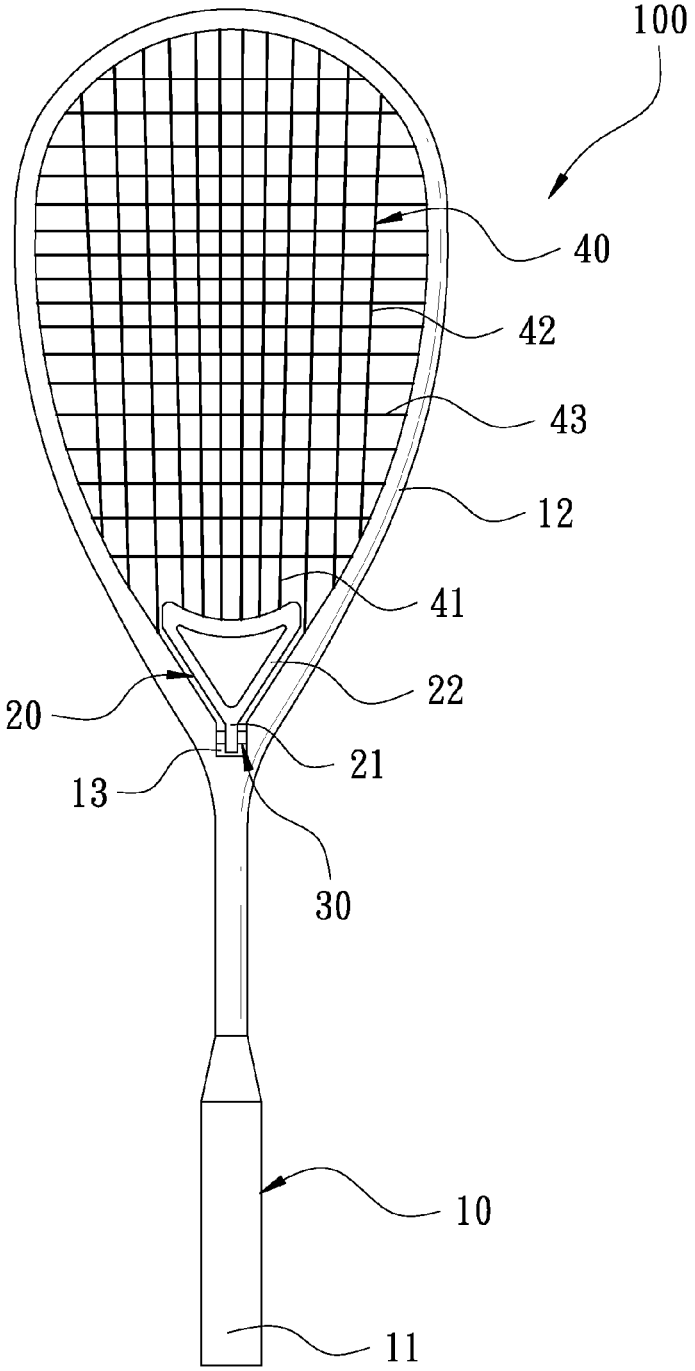
FIG. 2 is a front view of a first preferred embodiment of a racket with a movable throat in the present invention.
Figure 3:
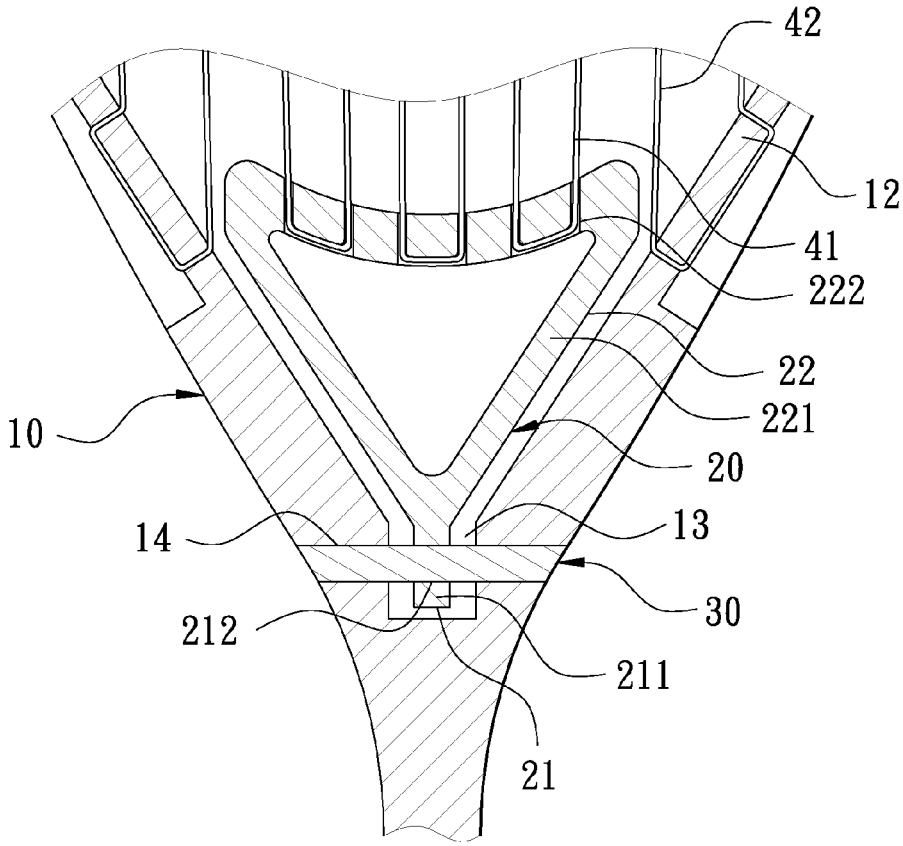
FIG. 3 is a front cross-sectional view of the first preferred embodiment of the racket with a movable throat in the present invention.
Figure 4:
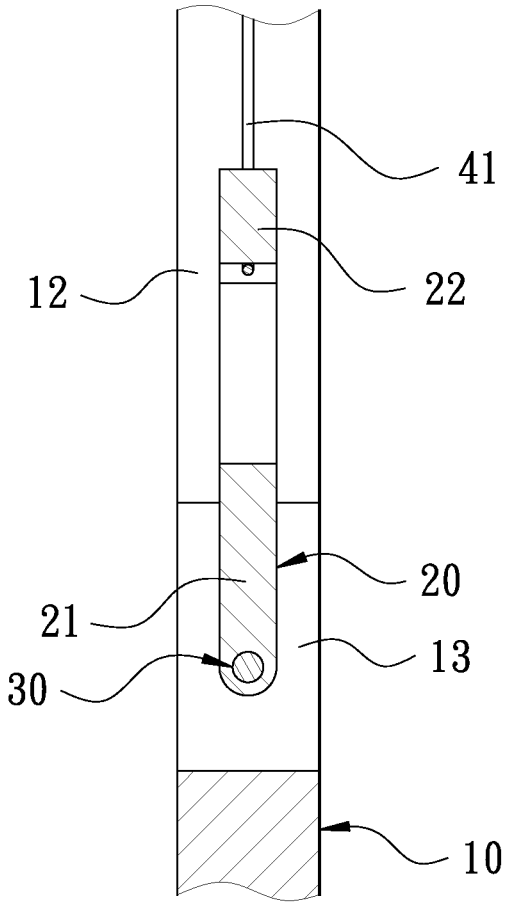
FIG. 4 is a side cross-sectional view of the first preferred embodiment of the racket with a movable throat in the present invention.

A first preferred embodiment of a racket 100 with a movable throat in the present invention, as shown in FIGS. 2, 3 and 4, includes a racket body 10, a throat member 20 and a racket net 40 as main components combined together.

The racket body 10 is formed with a grip 11 having one end provided with a racket frame 12, which has an inner wall disposed with a pivotal groove 13 at a location corresponding with the grip 11. The grip 11 has a peripheral side bored with a first through insert hole 14 communicating with the pivotal groove 13.

The throat member 20 has one end formed with a pivotal portion 21 to be pivotally set in the pivotal groove 13 and another end extending out of the pivotal groove 13 and provided with a connecting portion 22. In this preferred embodiment, the pivotal portion 21 is a rod 211 having a peripheral side bored with a second through insert hole 212 corresponding with the first insert hole 14 of the grip 11, and a pivot 30 is inserted through both the first insert hole 14 and the second insert hole 212 for pivotally fixing the pivotal portion 21 of the throat member 20 in the pivotal groove 13. The connecting portion 22 of the throat member 20 is an endless body 221 having an upper portion bored with a plurality of through holes 222 spaced apart.

The racket net 40 secured with the inner wall of the racket frame 12 is composed of a plurality of first main strings 41 and second main strings 42 that are generally arranged axially along the grip 11, and a plurality of cross strings 43 generally fabricated diametrically along the grip 11. The first main strings 41 respectively have one end connected with the inner wall of the racket frame 12 and another end connected with the connecting portion 22 of the throat member 20. In this preferred embodiment, the first main strings 41 respectively have another end inserted and secured in the through holes 222, while the second main strings 42 have their two ends connected with the inner wall of the racket frame 12. This is only a preferred embodiment and actually, it will do even if the racket net 40 is provided with no second main strings 42.

Figure 5:
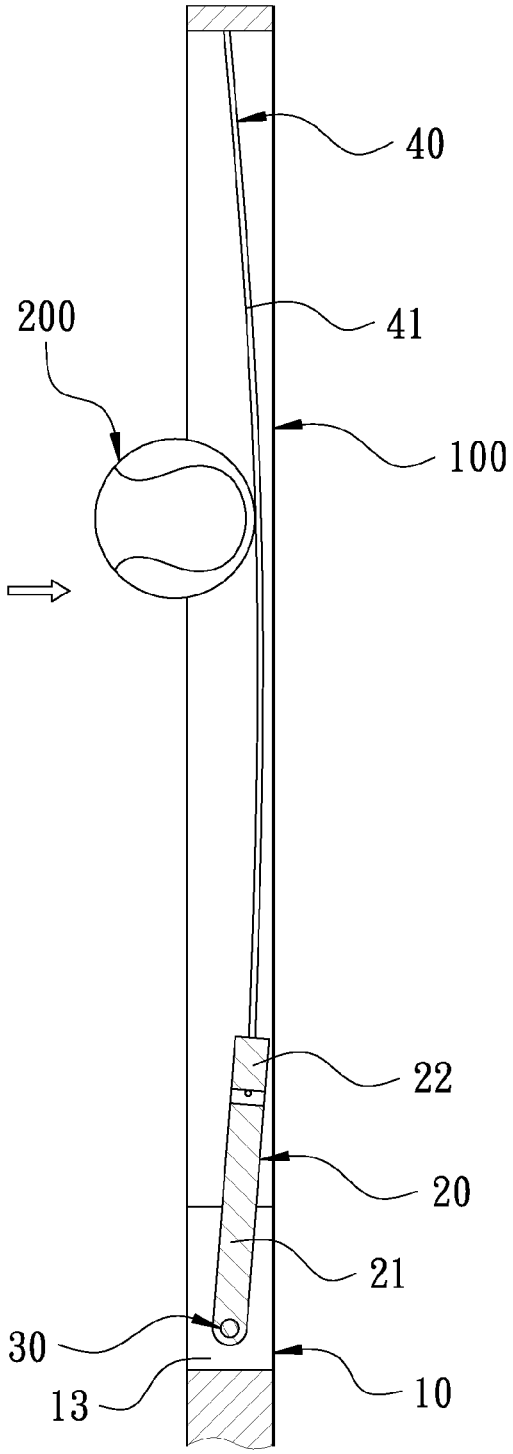
FIG. 5 is a side cross-sectional view of the first preferred embodiment of the racket with a movable throat in the present invention, showing a condition when a ball dashes against the racket net.

Referring to FIG. 5, as mentioned above, the first main strings 41 of the racket net 40 are connected with the connecting portion 22 of the throat member 20 and the pivotal portion 21 of the throat member 20 is pivotally received in the pivotal groove 13 at the inner wall of the racket frame 12. Therefore, when the racket 100 of this invention is employed to hit a ball 200, the impact force of the ball 200 dashing against the racket net 40 will be transmitted to the throat member 20 via the first main strings 41 and synchronously, the throat member 20, with the pivot 30 acting as a shaft center, will be actuated to sway in the direction of the impact force. Thus, not only the time that the ball 200 contacts with the racket net 40 can be prolonged to enable a user to control the ball 200 more easily, but also all the first main strings 41 can be actuated to sway together with the throat member 20 to produce greater resilient strength for enhancing power of ball hitting. In addition, swaying of the throat member 20 can produce buffer effect for greatly lowering the impact force that is transmitted to the racket body 10 and reducing shock produced during hitting balls, able to avoid causing sports injuries to a user who has employed the racket body to hit balls for a long period of time.

Figure 6:
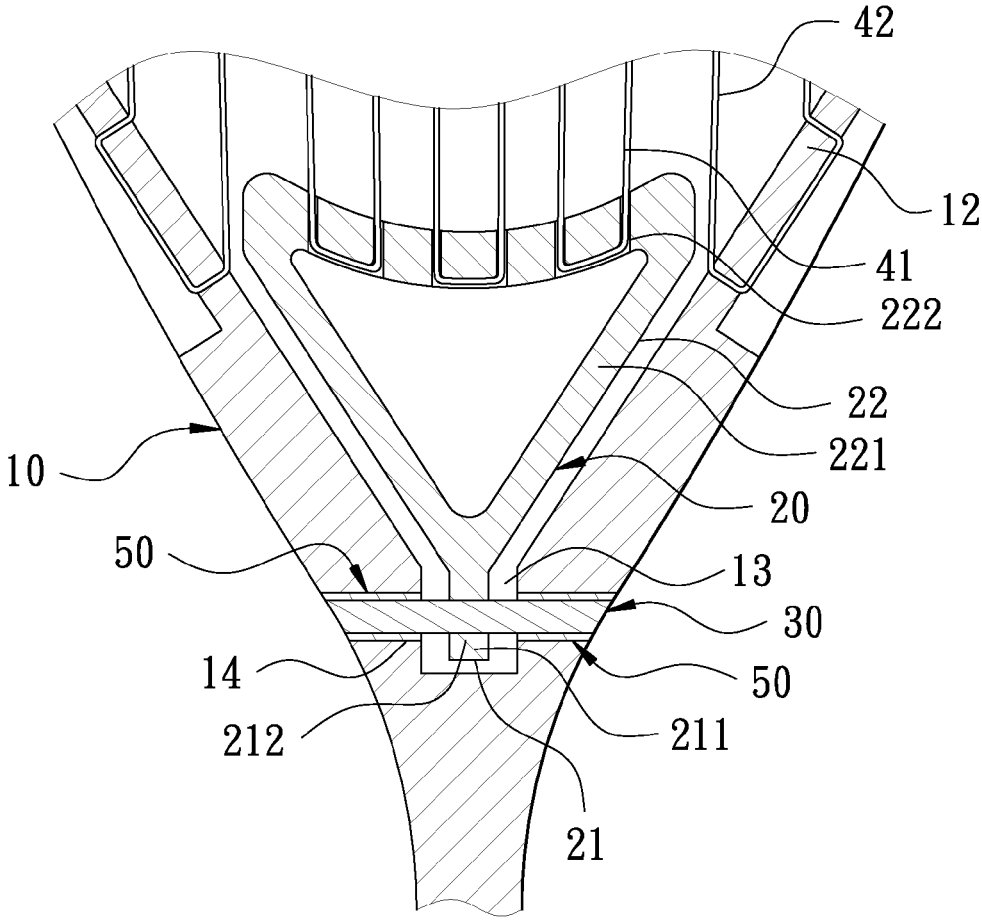
FIG. 6 is a front cross-sectional view of a second preferred embodiment of a racket with a movable throat in the present invention.

A second preferred embodiment of a racket with a movable throat in the present invention, as shown in FIG. 6, has almost the same structure as that of the first preferred embodiment, except that a rubber bushing 50 is fitted around parts of the pivot 30, which are inserted in the first insert hole 14, so as to produce cushioning effect through deformation of the rubber bushing 50 for absorbing shock produced during hitting balls.

Specifically, this invention has the following advantages.

1. When a user hits a ball with the racket of this invention, the impact force of the ball dashing against the racket net can be transmitted to the throat member to actuate the throat member to sway in the direction of the impact force, thus able to prolong the contact time of the ball with the racket net to enable a user to control the ball more easily.

2. When a user employs the racket of this invention to hit balls, all the first main strings of the racket net will be actuated to sway together with the throat member, able to produce greater resilient strength for elevating power of ball hitting.

3. When a user hits balls with the racket of this invention, the throat member will be forced to sway in the direction of the impact force to form buffer effect for greatly lowering the impact force transmitted to the racket body and reducing the shock produced during ball hitting, thus avoiding causing sports injuries to a user who has used the racket body to hit balls for long.

4. The pivot of the racket of this invention has an outer side fitted thereon with a rubber bushing for producing buffer effect via deformation of the rubber bushing, able to further absorb shock produced during ball hitting.

While the preferred embodiments of the invention have been described above, it will be recognized and understood that various modifications may be made therein and the appended claims are intended to cover all such modifications that may fall within the spirit and scope of the invention.

What is claimed is:

1. A racket with a movable throat comprising:

a racket body formed with a grip, said grip having one end provided with a racket frame, said racket frame having an inner wall disposed with a pivotal groove at a location corresponding with said grip;

a throat member having one end formed with a pivotal portion to be pivotally fixed in said pivotal groove, said throat member having another end extending out of said pivotal groove and provided with a connecting portion; and a racket net secured with inner wall of said racket frame, said racket net composed of a plurality of first main strings that are generally arranged axially along said grip and a plurality of cross strings that are generally fabricated diametrically along said grip, said first main strings respectively having one end connected with an inner wall of said racket frame and another end connected with said connecting portion of said throat member.

2. The racket with a movable throat as claimed in claim 1, wherein said grip has a peripheral side bored with a first through insert hole communicating with said pivotal groove, and said pivotal portion of said throat member is a rod having a peripheral side bored with a second through insert hole corresponding with said first through insert hole, a pivot inserted in both said first through insert hole and said second through insert hole for pivotally fixing said pivotal portion of said throat member in said pivotal groove.

3. The racket with a movable throat as claimed in claim 2, wherein said pivot has a part, which is inserted in said first insert hole, fitted thereon with a rubber bushing.

4. The racket with a movable throat as claimed in claim 1, wherein said connecting portion of said throat member is an endless body having an upper portion bored with a plurality of through holes spaced apart, and said first main strings respectively have another end inserted and secured in said through holes.

5. The racket with a movable throat as claimed in claim 1, wherein said racket net is further provided with a plurality of second main strings that are generally arranged axially along said grip, said second main strings respectively having two ends connected with an inner wall of said racket frame.

* * * * *